US010821491B2

(12) United States Patent
Heinrichs et al.

(10) Patent No.: US 10,821,491 B2
(45) Date of Patent: Nov. 3, 2020

(54) METHOD AND DEVICE FOR MONITORING THE FUNCTIONAL STATE OF A SHAPING TOOTH ARRANGEMENT ON A FORMING TOOL

(71) Applicant: FELSS Systems GmbH, Koenigsbach-Stein (DE)

(72) Inventors: Serjosha Heinrichs, Pforzheim (DE); Dennis Beihofer, Kaempfelbach (DE); Michael Marre, Karlsruhe (DE); Matthias Kluge, Duerrn (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 160 days.

(21) Appl. No.: 15/893,968

(22) Filed: Feb. 12, 2018

(65) Prior Publication Data

US 2018/0229285 A1 Aug. 16, 2018

(30) Foreign Application Priority Data

Feb. 13, 2017 (EP) ..... 17155857

(51) Int. Cl.
*B21C 31/00* (2006.01)
*B21C 23/18* (2006.01)
(Continued)

(52) U.S. Cl.
CPC ..... *B21C 31/00* (2013.01); *B21C 23/18* (2013.01); *B21C 23/218* (2013.01); *B21C 51/00* (2013.01);
(Continued)

(58) Field of Classification Search
None
See application file for complete search history.

(56) References Cited

U.S. PATENT DOCUMENTS 4,590,573 A * 5/1986 Hahn ..... G05B 19/4166 318/567
5,445,020 A 8/1995 Rosensweig
(Continued)

FOREIGN PATENT DOCUMENTS

CN 105537302 A 5/2016
DE 102006037091 B3 9/2007
(Continued)

OTHER PUBLICATIONS

Chinese Office Action dated Oct. 18, 2019 with English translation (issued in the corresponding Chinese patent application 201810150480.8).
(Continued)

*Primary Examiner* — Jennifer L Norton
(74) *Attorney, Agent, or Firm* — Collard & Roe, P.C.

(57) ABSTRACT

In a method for monitoring a functional state of a shaping tooth arrangement on a forming tool, at measurement times which are temporally staggered with respect to each other at a plurality of measurement locations on the shaping tooth arrangement, a tooth arrangement force is measured which acts on the shaping tooth arrangement. At each of the measurement times for each of the measurement locations an instantaneous local tooth arrangement force is thereby determined. A previous instantaneous local tooth arrangement force and a subsequent instantaneous local tooth arrangement force are correlated with each other to determine a local state identification value. On the basis of the local state identification values associated with the measurement locations, information is obtained relating to the functional state of the shaping tooth arrangement.

17 Claims, 4 Drawing Sheets

(51) Int. Cl.

| | |
|---|---|
| ***B21J 9/20*** | (2006.01) |
| ***B21K 1/06*** | (2006.01) |
| ***B21C 23/21*** | (2006.01) |
| ***B21C 51/00*** | (2006.01) |
| *B21J 5/12* | (2006.01) |
| *B21K 1/30* | (2006.01) |

(52) U.S. Cl.

CPC ..... *B21J 9/20* (2013.01); *B21K 1/066* (2013.01); *B21J 5/12* (2013.01); *B21K 1/30* (2013.01)

(56) References Cited

U.S. PATENT DOCUMENTS

| | | | | |
|---|---|---|---|---|
| 5,539,172 | A * | 7/1996 | Takase | B23F 17/006 219/69.2 |
| 6,148,985 | A * | 11/2000 | Wagner | B30B 1/08 192/130 |
| 6,212,929 | B1 | 4/2001 | Binhack | |
| 6,418,769 | B1 * | 7/2002 | Schreiner | H01R 43/0486 29/705 |
| 6,487,506 | B1 | 11/2002 | Schoch | |
| 7,447,614 | B2 | 11/2008 | Ghaboussi et al. | |
| 8,091,400 | B2 * | 1/2012 | Binhack | B21C 23/004 72/253.1 |
| 8,839,497 | B2 * | 9/2014 | Shin | B23B 27/10 219/121.65 |
| 9,331,447 | B2 * | 5/2016 | Charlton | H01R 43/0486 |
| 9,519,282 | B2 * | 12/2016 | Morfino | G05B 19/401 |
| 9,789,582 | B2 * | 10/2017 | Haas | B24B 39/006 |
| 2008/0115552 | A1 | 5/2008 | Arakawa | |
| 2010/0029179 | A1 * | 2/2010 | Cloutier | B24B 47/20 451/9 |
| 2010/0083723 | A1 | 4/2010 | Szuba et al. | |
| 2020/0094310 | A1 * | 3/2020 | Huff | B21J 15/285 |

FOREIGN PATENT DOCUMENTS

| | | | |
|---|---|---|---|
| DE | 102010017592 | | 12/2011 |
| DE | 102012101952 | | 9/2013 |
| JP | S5913542 | A | 1/1984 |
| JP | H0716687 | A | 1/1995 |
| JP | H07144244 | A | 6/1995 |
| JP | H07164199 | A | 6/1995 |
| JP | H07260615 | A | 10/1995 |
| JP | H11218451 | A | 8/1999 |
| JP | 2000301262 | A | 10/2000 |
| WO | 2008017358 | | 2/2008 |
| WO | 2011160809 | | 12/2011 |

OTHER PUBLICATIONS

Japanese Office Action dated Nov. 25, 2019 with English translation (issued in the corresponding Japanese patent application 2018-020002).

Japanese Search Report dated Nov. 21, 2019 with English translation (issued in the corresponding Japanese patent application 2018-020002).

Canadian Office Action dated Jan. 23, 2020 (issued in the corresponding Canadian patent application 2,992,215).

European Office Action in EP 17155857.0 dated Jul. 24, 2017 with English translation of relevant parts.

Indian Office Action dated Jul. 24, 2020 issued in corresponding Indian Application Ser. No. 201834001356 (with English translation).

Korean Office Action dated Jul. 22, 2020 issued in corresponding Korean Application Ser. No. 10 2018 0016320 (with English translation).

* cited by examiner

METHOD AND DEVICE FOR MONITORING THE FUNCTIONAL STATE OF A SHAPING TOOTH ARRANGEMENT ON A FORMING TOOL

CROSS REFERENCE TO RELATED APPLICATIONS

This application claims priority under 35 USC 119 of European Patent Application No. 17 155 857.0 filed on Feb. 13, 2017, the disclosure of which is herein incorporated by reference.

BACKGROUND OF THE INVENTION

The invention relates to a method for monitoring the functional state of a shaping tooth arrangement on a forming tool for forming preferably metal workpieces, wherein during a stroke, which the shaping tooth arrangement and at least one workpiece which is intended to be formed by means of the shaping tooth arrangement and which is in contact with the shaping tooth arrangement carry out relative to each other along a movement path, at measurement times which are temporally staggered with respect to each other a tooth arrangement force which acts on the shaping tooth arrangement as a result of the stroke is measured in each case.

The invention further relates to a production method in which a preferably metal workpiece is formed by a shaping tooth arrangement which is provided on a forming tool and the workpiece which is in contact with the shaping tooth arrangement being moved relative to each other with a stroke along a movement path.

The invention further relates to a device for carrying out the above method, having a measuring device, by means of which, during a stroke which the shaping tooth arrangement and a workpiece which is intended to be formed by the shaping tooth arrangement and which is in contact with the shaping tooth arrangement carry out relative to each other along a movement path, a tooth arrangement force can be measured at measurement times which are temporally staggered with respect to each other, wherein the tooth arrangement force acts on the shaping tooth arrangement as a result of the stroke.

The invention finally relates to a forming machine for forming preferably metal workpieces, having a forming tool which has a shaping tooth arrangement, having a forming drive, by means of which the shaping tooth arrangement of the forming tool and a workpiece which is intended to be formed by means of the shaping tooth arrangement and which is in contact with the shaping tooth arrangement can be moved relative to each other with a stroke along a movement path, and having a device of the above-mentioned type for monitoring the functional state of the shaping tooth arrangement on the forming tool.

In the case of the prior art known from practice, shaping tooth arrangements on forming dies are monitored for tooth breakage and tooth wear. To this end, on a forming die which is intended to be monitored, the tooth arrangement forces which are acting thereon during a workpiece processing operation are detected by means of a single force sensor. As a result of a numerical evaluation of the tooth arrangement forces measured by the single sensor, information is obtained relating to the functional state of the monitored tooth arrangement.

SUMMARY OF THE INVENTION

An object of the present invention is to improve the reliability of the tool monitoring with regard to the prior art.

This object is achieved according to the invention by a method for monitoring a functional state of a shaping tooth arrangement on a forming tool for forming preferably metal workpieces, wherein during a stroke which the shaping tooth arrangement and at least one workpiece which is intended to be formed by means of the shaping tooth arrangement and which is in contact with the shaping tooth arrangement carry out relative to each other along a movement path, a tooth arrangement force can be measured at measurement times which are temporally staggered with respect to each other, wherein the tooth arrangement force acts on the shaping tooth arrangement as a result of the stroke.

In the case of the invention, at measurement times which are temporally staggered with respect to each other the tooth arrangement forces, which occur on the shaping tooth arrangement of a forming tool when the shaping tooth arrangement and a workpiece which is intended to be formed carry out a stroke relative to each other, are determined not only at one, but instead at a plurality of measurement locations on the shaping tooth arrangement. According to the invention, there is accordingly produced a spatial resolution of the tooth arrangement forces which occur. The measurement locations are spatially offset with respect to each other and may be arranged directly on the shaping tooth arrangement but are preferably spaced apart from the shaping tooth arrangement.

For each of the measurement locations on the shaping tooth arrangement at each of the measurement times which are temporally staggered with respect to each other, an instantaneous local tooth arrangement force is determined. The previous instantaneous local tooth arrangement force which was determined at an earlier measurement time for a measurement location and the subsequent instantaneous local tooth arrangement force determined for the same measurement location at a later measurement time are correlated with each other. On the basis of the relationship between the earlier instantaneous local tooth arrangement force and the subsequent instantaneous local tooth arrangement force for each of the measurement locations on the shaping tooth arrangement a local state identification value which is associated with this measurement location and which is specific to the functional state of the shaping tooth arrangement is determined. The measurement times are preferably selected in such a manner that, from the stroke carried out by the shaping tooth arrangement and the workpiece which is intended to be processed relative to each other, one or more phases are detected, which are particularly informative with regard to the functional state of the shaping tooth arrangement. Which phases of the stroke of the shaping tooth arrangement and workpiece are suitable in this respect can, for example, be established empirically prior to a specific monitoring process. In order to determine the specific local state identification values, sequential instantaneous local tooth arrangement forces—in particular sequential instantaneous local tooth arrangement forces during a time range in which the shaping tooth arrangement and the workpiece which is intended to be formed carry out a portion of the stroke which is particularly informative regarding the functional state of the shaping tooth arrangement—can be continuously established for each of the measurement locations and correlated with each other. From the local state identification values determined for the different measurement locations on the shaping tooth arrangement, the functional state of the shaping tooth arrangement is finally derived. In this instance, for each of the measurement locations a single local state identification value, but also a plurality of local state identification values can be taken into account.

The method according to the invention for tooth arrangement monitoring is integrated in the production method according to the invention.

In a preferred embodiment of the invention, the presence of a tooth breakage on the shaping tooth arrangement and/or the wear state of the shaping tooth arrangement is monitored as a functional state of the shaping tooth arrangement.

In the case of the invention, the functional state of the shaping tooth arrangement is monitored using the tooth arrangement forces which are effective when the shaping tooth arrangement and the workpiece which is intended to be shaped are moved relative to each other with a working stroke and/or when the shaping tooth arrangement and the workpiece which is intended to be shaped, following a working stroke, carry out a return stroke relative to each other, which is counter to the working stroke. In this instance, it is possible for phases of the working stroke and/or the return stroke which are particularly informative regarding the functional state of the shaping tooth arrangement to be defined and monitored. In the case of the working stroke, for example, the phase from starting the material flow on the workpiece to be processed to the end of the working stroke, in particular until a return stroke which follows the working stroke is initiated.

The instantaneous local tooth arrangement forces are preferably determined at measurement locations which are offset perpendicularly to the movement path of the stroke which is carried out relative to each other by the shaping tooth arrangement and the workpiece which is intended to be formed. In particular, the measurement locations are distributed in this instance in a peripheral direction about the movement path. The measurement device of the device according to the invention has a plurality of force sensors which form the measurement locations on the shaping tooth arrangement and which are arranged accordingly.

In the case of a preferred embodiment of the forming machine according to the invention, the measurement locations or the force sensors are provided on a tool receiving member of the forming tool which is provided with the shaping tooth arrangement.

In each of the measurement locations on the shaping tooth arrangement, the previous instantaneous local tooth arrangement force and the subsequent instantaneous local tooth arrangement force are preferably correlated with each other by the value of the previous instantaneous local tooth arrangement force and the value of the subsequent instantaneous local tooth arrangement force being compared with each other.

On the basis of the comparison result in another embodiment of the invention, for each of the measurement locations on the shaping tooth arrangement, there is determined as a specific local state identification value for the functional state of the shaping tooth arrangement a mean value of the value of the instantaneous local tooth arrangement force and/or a progression of the value of the instantaneous local tooth arrangement force over time and/or a mathematical derivative of the progression over time of the value of the instantaneous local tooth arrangement force and/or a mathematical integral of the progression over time of the value of the instantaneous local tooth arrangement force. Preferably, for each of the measurement locations there is/are established as the local state identification value(s): the mean value of the values of the instantaneous local tooth arrangement force and/or the mean value of the absolute values of the first and/or second derivative of the time-dependent progression of the value of the instantaneous local tooth arrangement force and/or the mean value of the absolute values of, the integral of the time-dependent progression of the value of the instantaneous local tooth arrangement force.

In a development of the invention, on the basis of the local state identification values which are associated with the measurement locations, information is obtained relating to the functional state of the shaping tooth arrangement by the local state identification value determined for the measurement location being compared with a local reference state identification value associated with the measurement location for each of the measurement locations and, using the comparison result, information being obtained relating to the functional state of the shaping tooth arrangement.

In particular, prior to the specific monitoring process, the local reference state identification values associated with the measurement locations are preferably empirically established.

In a preferred embodiment of the invention, in order to evaluate the instantaneous local tooth arrangement forces determined for the different measurement locations of the shaping tooth arrangement, a neuronal network is used. In the neuronal network, in particular the local state identification values associated with the different measurement locations and specific to the functional state of the shaping tooth arrangement are input as one field in each case and evaluated with regard to the functional state of the shaping tooth arrangement. For example, using the neuronal network, information is obtained as to whether a tooth breakage is present on the shaping tooth arrangement and/or whether the shaping tooth arrangement is worn. In this instance, the local state identification values determined for the specific forming process are compared with local reference state identification values. In order to obtain local reference state identification values, during forming operations on a plurality of workpieces, the local state identification value(s) specific to the functional state of the shaping tooth arrangement is/are determined per workpiece for each measurement location. In this instance, for the measurement locations, for example, the mean values of the values of the instantaneous local tooth arrangement force and/or the mean values of the absolute values of the first and/or the second derivative of the time-dependent progression of the value of the instantaneous local tooth arrangement force and/or the mean values of the absolute values of the integral of the time-dependent progression of the value of the instantaneous local tooth arrangement force are determined. If all four mentioned local state identification values are established, during the workpiece forming operation four mean values are obtained for each workpiece per measurement location and consequently, for example, with four measurement locations, a total of 16 mean values per workpiece.

In order to teach a neuronal network, per workpiece 16 mean values of the type mentioned are input in a piece of software together with the information as to whether the shaping tooth arrangement used for the forming of the workpiece was worn or broken or new when the mean values were established. Using a sufficiently large number of workpieces or data, the software forms a neuronal network. The important aspect in the teaching of the system is that the local state identification values associated with the individual measurement locations are input separately as a local state identification value (individual field) for each measurement location and not combined with each other. The neuronal network taught in this manner is then used for subsequent forming processes for evaluating the functional state of the shaping tooth arrangements used in these forming processes.

The information about the functional state of the shaping tooth arrangement of the forming tool, which information is obtained by the method according to the invention or by the device according to the invention are used in a preferred embodiment of the forming machine according to the invention to control the forming drive, by which the shaping tooth arrangement of the forming tool and a workpiece which is intended to be shaped are moved relative to each other. In this instance, it is for example possible to stop the forming tool when a tooth breakage is identified on the shaping tooth arrangement of the forming tool. Additionally or alternatively, it is conceivable for a warning notification to be generated for the machine operator when a tooth breakage is detected and/or when the monitored wear of the shaping tooth arrangement has reached a specific degree.

BRIEF DESCRIPTION OF THE DRAWINGS

The invention is explained in greater detail below with reference to exemplary schematic illustrations, in which.

DETAILED DESCRIPTION OF THE EMBODIMENTS

Axial forming is an extrusion method and consequently a forming method in which a workpiece is formed by the application of pressure by means of a forming tool. By the forming tool, the workpiece to be processed is acted on with a pressing force which results in the material of the workpiece to be formed beginning to flow. When the yield point of the material is exceeded, the actual forming process begins on the workpiece. During the forming process, the shape of the workpiece is changed in a manner predetermined by the geometry of the forming tool as a result of a working stroke carried out relative to each other by the workpiece and the forming tool along a movement path.

The recursive axial forming represents a specific form of the axial forming. The desired shaping of the relevant workpiece is with recursive axial forming not produced with a single continuous working stroke, but instead by a plurality of sequential working strokes, wherein a working stroke which includes an application of pressure on the workpiece is followed in each case by a return stroke which is carried out by the workpiece and the forming tool relative to each other in the opposite direction of the working stroke and in which the forming tool is lifted off from the workpiece.

A device and a method for recursive axial forming is exemplary disclosed in U.S. Pat. No. 6,212,929 B1.

Figure 1:
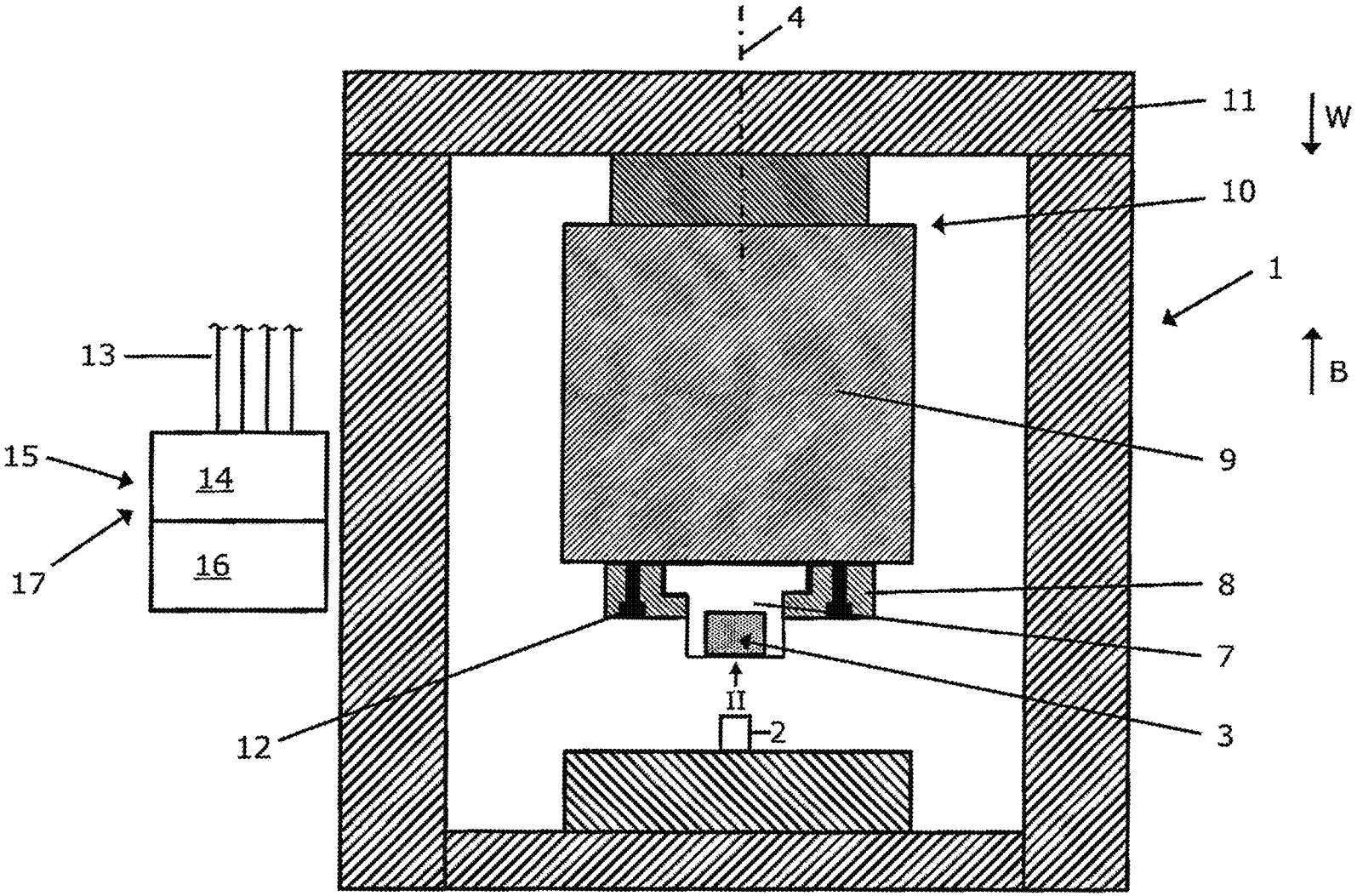
FIG. 1 shows a forming machine for recursive axial forming, having a forming tool and having a device for monitoring the functional state of a shaping tooth arrangement of the forming tool.
Figure 2:
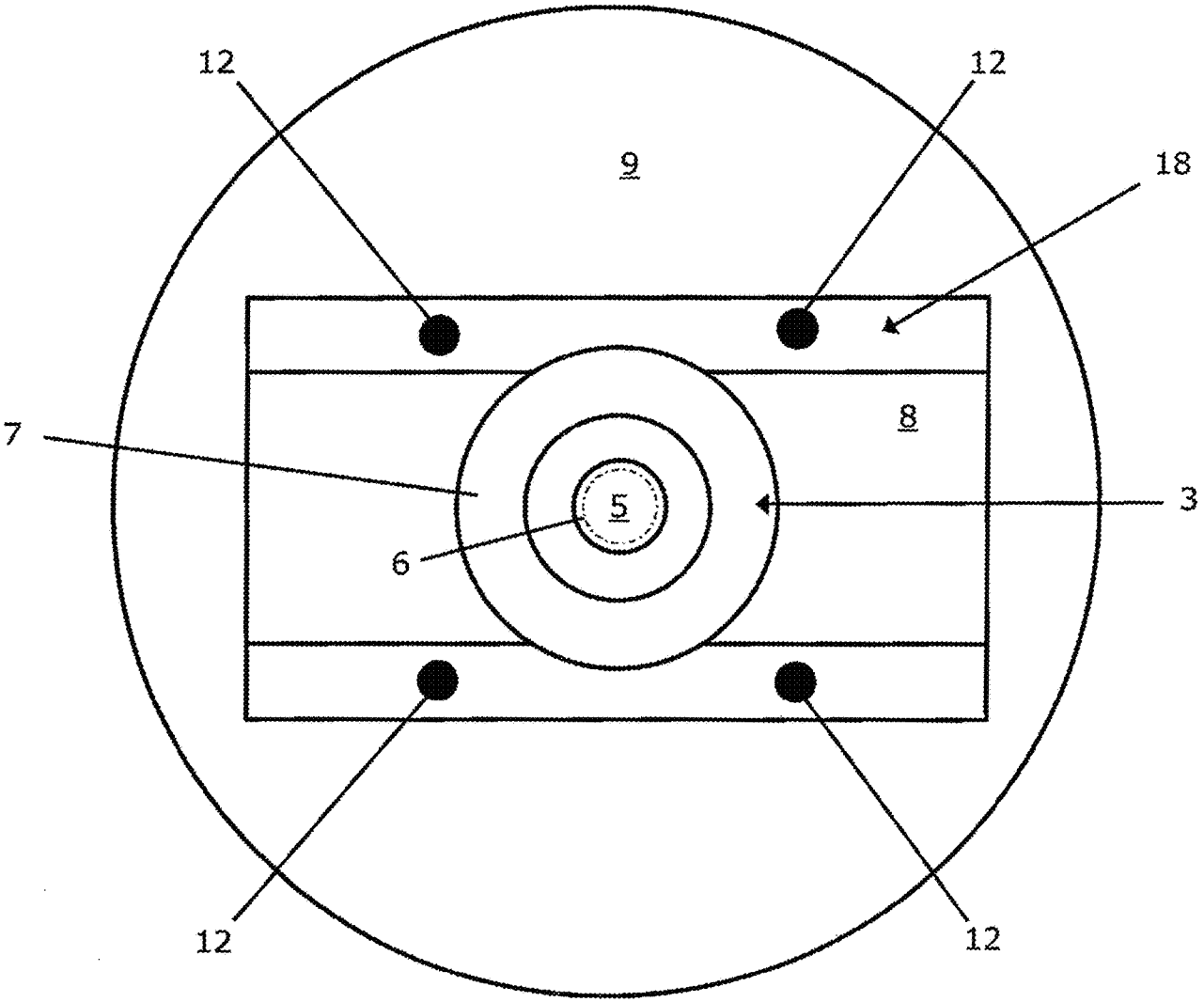
FIG. 2 shows the forming tool of the forming machine according to FIG. 1 as a view in the direction of the arrow II in FIG. 1.

By means of recursive axial forming on a forming machine 1 which is illustrated in a highly schematic manner in FIG. 1, a workpiece which is intended to be formed in the form of a shaft blank 2 is formed using a forming die 3 of conventional construction type which is provided as a forming tool, in particular provided with a tooth arrangement whose teeth extend along a forming axis 4 which is illustrated in FIG. 1 with a dot-dash line. In conventional manner, the forming die 3 has a die opening 5 which can be seen in FIG. 2 and whose axially parallel wall is provided over the entire periphery with a shaping tooth arrangement 6. The shaping tooth arrangement 6 is indicated in FIG. 2 by a dot-dash circular line along which the tooth tips of the shaping tooth arrangement 6 are arranged. The teeth of the shaping tooth arrangement 6 extend along the forming axis 4. In the intermediate tooth spaces of the shaping tooth arrangement 6 during the forming process, the outer tooth arrangement on the shaft blank 2 is formed.

A shaping tooth arrangement on a forming die is exemplary disclosed in WO 2011/160809A1.

For reinforcement in a radial direction, the forming die 3 is fitted in known manner in a reinforcement 7. By means of the reinforcement 7, the forming die 3 is fixed in a die receiving member 8 of the forming machine 1 which die receiving member 8 is provided as a tool receiving member. The die receiving member 8 is in turn mounted to a pressing cylinder 9 of a hydraulic piston/cylinder arrangement 10 which is provided as a forming drive. The piston/cylinder arrangement 10 is supported on a pressing frame 11 of the forming machine 1.

In the die receiving member 8, a total of four force measurement sensors 12 which form a measurement device 18 are embedded. The force measurement sensors 12 measure at four measurement locations spatially resolved on the forming die 3 the pressing or tooth arrangement force acting on the shaping tooth arrangement 6 of the forming die 3 when the forming die 3 and the shaping tooth arrangement 6 and the shaft blank 2 which is in contact with the shaping tooth arrangement 6 carry out a stroke (working stroke or return stroke) relative to each other along the forming axis 4 which is provided as a movement path. The force measurement sensors 12 and with them the measurement locations are arranged so as to be offset with respect to each other perpendicularly to the forming axis 4 around the forming axis 4, Since the forming die 3 fits precisely in the reinforcement 7 and the reinforcement 7 is supported in a play-free manner on the die receiving member 8, using the force measurement sensors 12 the pressing or tooth arrangement forces acting on the shaping tooth arrangement 6 of the forming die 3 can be precisely acquired.

By means of connection lines 13, the force measurement sensors 12 are connected to a numerical evaluation device 14. The numerical evaluation device 14 is a microprocessor. Together with the force measurement sensors 12 or the measurement device 18, the numerical evaluation device 14 forms a device 15 for monitoring the functional state of the shaping tooth arrangement 6 on the forming die 3.

Via the numerical evaluation device 14, the device 15 for monitoring the functional state of the shaping tooth arrangement 6 is connected to a numerical drive control 16 of the forming drive 10 of the forming machine 1. Both the numerical evaluation device 14 of the device 15 and the numerical drive control 16 of the forming drive 10 are integrated in a numerical machine control 17 of the forming machine 1.

For the recursive axial forming of the shaft blank 2, during a production process, the forming die 3 is moved in the manner described in the introduction relative to the shaft blank 2 which is clamped on a press table of the forming machine 1 by means of a conventional workpiece clamping system with alternating working and return strokes along the forming axis 4. As a result of a corresponding control of the forming drive 10 by means of the numerical drive control 16, each working stroke of the forming die 3 and the shaping tooth arrangement 6 carried out in the direction of an arrow W in FIG. 1 is followed by a return stroke of the forming die 3 and the shaping tooth arrangement 6 in the direction of an arrow B in FIG. 1.

Figure 3:
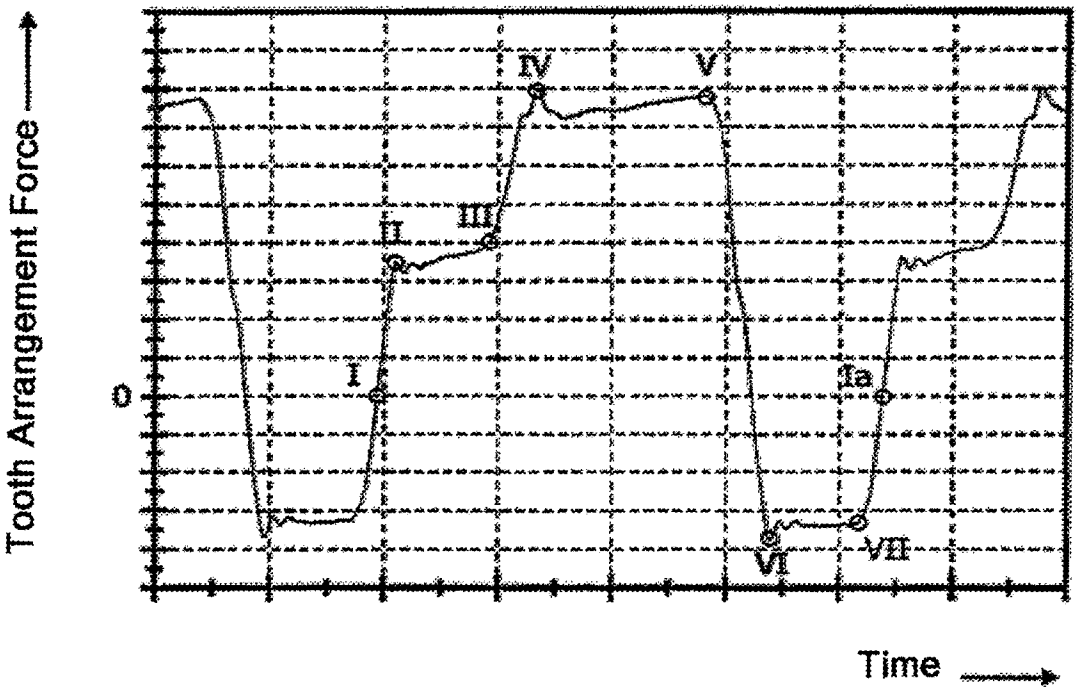
FIG. 3 shows an exemplary progression of the tooth arrangement force over time, which tooth arrangement force is acting during the recursive axial forming on the shaping tooth arrangement of the forming tool according to FIGS. 1 and 2.

The progression over time of the tooth arrangement force acting on the shaping tooth arrangement 6 of the forming die 3 during recursive axial forming of the shaft blank 2 is illustrated in FIG. 3 by way of example.

Following a return stroke of the shaping tooth arrangement 6 at the end of which the shaping tooth arrangement 6 is retracted over a previously shaped part-length of the shaft blank 2 with respect to the still-unshaped remaining length of the shaft blank 2, at point I the shaping tooth arrangement 6 moves into contact again with the shaft blank 2. At point III, the shaping tooth arrangement 6 has run in the direction W of the working stroke onto the still-unprocessed part-length of the shaft blank 2. The tooth arrangement force which has until then occurred on the shaping tooth arrangement 6 results from the friction which occurs when the shaping tooth arrangement 6 is moved over the already-processed part-length of the shaft blank 2. Point II marks in this instance the transition from static friction to sliding friction.

When the shaping tooth arrangement 6 has run in the direction W of the working stroke onto the still-unprocessed part-length of the shaft blank 2 (point III), during a continuation of the working stroke the shaft blank 2 is acted on by the shaping tooth arrangement 6 with a relatively significantly increasing pressure force until the material of the shaft blank 2 begins to flow (point IV).

After the material flow has been started on the shaft blank 2, the pressure force which is introduced into the shaft blank 2 via the shaping tooth arrangement 6 first significantly decreases. The shaping tooth arrangement 6 moves along the shaft blank 2 with the shaft blank 2 being formed. A lubricant film between the shaping tooth arrangement 6 of the forming die 3 which is moving in the direction W of the working stroke, on the one hand, and the shaft blank 2, on the other hand which lubricant film has been formed by lubricant which has been previously applied to the shaft bank 2, gradually degrades with continued movement of the shaping tooth arrangement 6. The degradation of the lubricant film is associated with an increase of the tooth arrangement force acting on the shaping tooth arrangement 6.

The value of the tooth arrangement force on the shaping tooth arrangement 6 ultimately reaches at point V a limit value previously defined and stored in the numerical drive control 16. On reaching the limit value, the numerical drive control 16 controls the forming drive 10 in such a manner that the movement of the shaping tooth arrangement 6 in the direction of the arrow W of the working stroke is interrupted and the shaping tooth arrangement 6 is retracted with a return stroke with respect to the still-unprocessed portion of the shaft blank 2 in the direction of the arrow B. Also during the return stroke, there acts on the shaping tooth arrangement 6 a friction force whose value reaches a local maximum at point VI. A return stroke portion follows in which a substantially constant friction force acts on the shaping tooth arrangement 6 and whose end is marked by point VII. The next working stroke of the shaping tooth arrangement 6 is finally initiated at point Ia.

Figure 4:
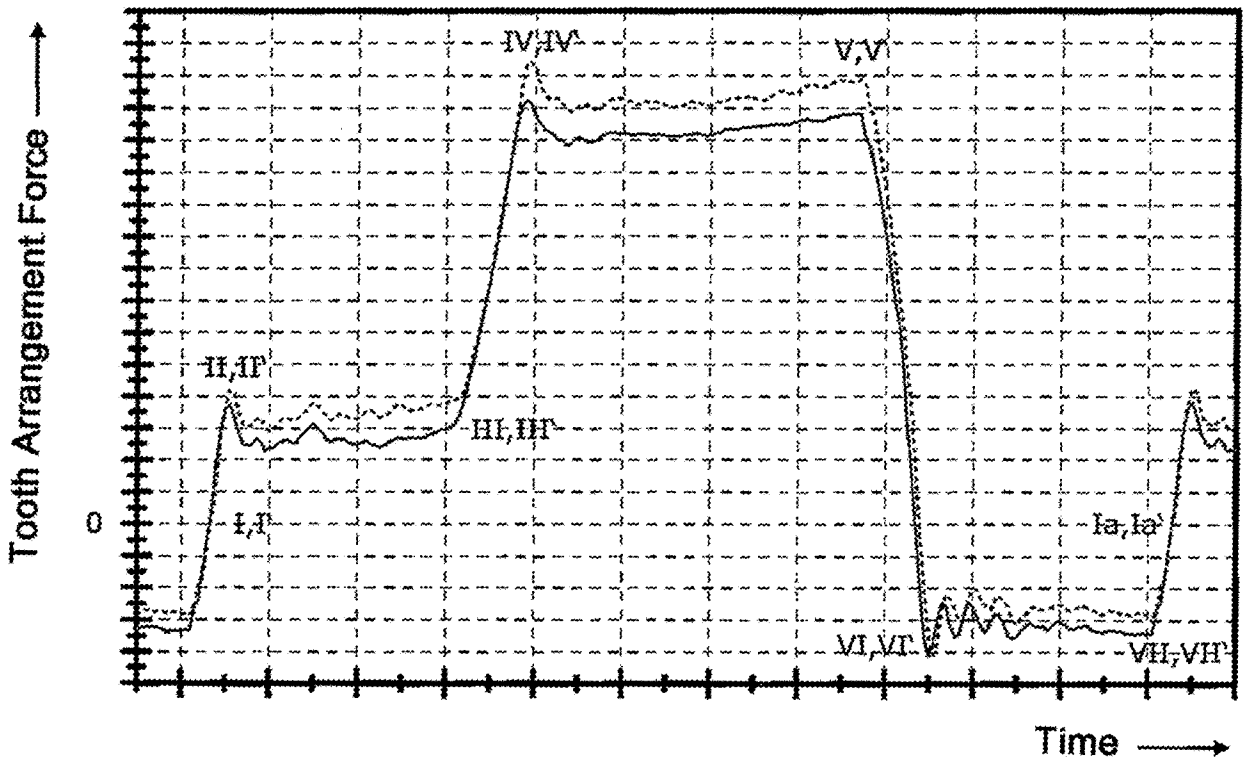
FIG. 4 shows exemplary progressions of the tooth arrangement force over time, which tooth arrangement force is acting during the recursive axial forming on the shaping tooth arrangement of the forming tool according to FIGS. 1 and 2 comparing a new and a worn shaping tooth arrangement.

In FIG. 4, the progression over time of the tooth arrangement force acting on the shaping tooth arrangement 6 of the forming die 3 is illustrated by way of example with dashed lines in the case of a new shaping tooth arrangement 6 and with solid lines in the case of a shaping tooth arrangement 6 which is worn.

Characteristic of the functional state of the shaping tooth arrangement 6 are

- the values of the tooth arrangement forces between point II, II', on the one hand, and point III, III', on the other hand,
- the values of the tooth arrangement forces between point IV, IV', on the one hand, and point V, V', on the other hand, and
- the values of the tooth arrangement forces between point VI, VI', on the one hand, and point VII, VII', on the other hand.

Using the measuring device 18 of the device 15 for monitoring the functional state of the shaping tooth arrangement 6 on the forming die 3, at the four measurement locations defined by the force measurement sensors 12 the tooth arrangement force acting on the shaping tooth arrangement 6 is continuously measured. For each of the measurement locations, time-dependent force progressions of the type illustrated in FIGS. 3 and 4 are generated in the numerical evaluation device 14 of the forming machine 1. The points of the force progression lines associate with each measurement time the instantaneous local tooth arrangement force determined at this measurement time for the relevant measurement location.

From the progression of the tooth arrangement force over time, for each of the measurement locations the points II, III, IV, V, VI and VII or the points II', III', IV', V', VI' and VII' are then taken and associated with each other in pairs (II, III; IV, V; VI, VII; II', III'; IV', V'; VI', VII'). For the time ranges or stroke portions between the points II, II'/III, III'; IV, IV'/V, V' and VI, VI'/VII/VII' using the evaluation device 14 for each of the measurement locations on the basis of the instantaneous local tooth arrangement forces there are determined as specific local state identification values: the mean value of the value of the instantaneous local tooth arrangement force, the mean value of the absolute values of the first and the second derivatives of the time-dependent progression of the value of the instantaneous local tooth arrangement force and the mean value of the absolute value of the integral of the time-dependent progression of the value of the instantaneous local tooth arrangement force.

The local state identification values obtained thereby for the different measurement locations are supplied to a neuronal network of the numerical evaluation device 14 in each case as a field and compared with previously obtained local reference state identification values. The local reference state identification values were previously defined by teaching the neuronal network.

In order to teach the neuronal network, the relevant local state identification values obtained with a sufficiently large number of workpiece shaping operations are supplied to the neuronal network together with information relating to the wear state of the used shaping tooth arrangement, which wear state was associated with the local state identification values obtained. As a result of the teaching operation, the neuronal network is configured in such a manner that the neuronal network during subsequent runs with local state identification values which have been obtained during forming processes selects decision pathways which with a high level of probability provide a correct statement about the wear state of the shaping tooth arrangement used during the forming processes. A corresponding piece of software for the numerical evaluation device 14 is, for example, provided by the company IBM under the name IBM SPSS Modeler.

A corresponding method is used when monitoring the shaping tooth arrangement 6 for the presence of a tooth breakage.

What is claimed is:

1. A method for monitoring a functional state of a shaping tooth arrangement on a forming tool for forming metal workpieces, comprising:

measuring by means of a force measurement device a tooth arrangement force which acts on the shaping tooth arrangement and which is formed during a relative movement of the shaping tooth arrangement and a workpiece which is intended to be formed by the shaping tooth arrangement and which is in contact with the shaping tooth arrangement, which relative movement is a stroke which the shaping tooth arrangement and the workpiece carry out relative to each other along a movement path of the relative movement of the shaping tooth arrangement and the workpiece, wherein by means of the force measurement device the tooth arrangement force is measured at measurement times which are temporally staggered with respect to each other and at a plurality of measurement locations on the shaping tooth arrangement, the force measurement device thus, determining at each of the measurement times for each of the measurement locations an instantaneous local tooth arrangement force as the tooth arrangement force, determining for each of the measurement locations a relationship between a previous instantaneous local tooth arrangement force determined at an earlier measurement time and a subsequent instantaneous local tooth arrangement force determined at a later measurement time by correlating for each of the measurement locations the previous instantaneous local tooth arrangement force and the subsequent instantaneous local tooth arrangement force with each other using a numerical evaluation device connected to the force measurement device, determining by means of the numerical evaluation device a local state identification value for each of the measurement locations based on the relationship between the previous instantaneous local tooth arrangement force and the subsequent instantaneous local tooth arrangement force, said local state identification value being associated with the measurement location for which the local state identification value has been determined and specific to a functional state of the shaping tooth arrangement, and obtaining by means of the numerical evaluation device information relating to the functional state of the shaping tooth arrangement based on the local state identification values associated with the measurement locations.

2. The method according to claim 1, wherein a presence of a tooth breakage on the shaping tooth arrangement and/or a wear state of the shaping tooth arrangement is monitored as the functional state of the shaping tooth arrangement.

3. The method according to claim 1, wherein the stroke during which the tooth arrangement force is measured at the measurement times which are temporally staggered with respect to each other and at a plurality of measurement locations on the shaping tooth arrangement is a working stroke which is carried out by the shaping tooth arrangement and the workpiece relative to each other.

4. The method according to claim 1, wherein the measurement locations are offset relative to each other perpendicularly to the movement path of the relative movement of the shaping tooth arrangement and the workpiece.

5. The method according to claim 1, wherein for each of the measurement locations on the shaping tooth arrangement, the previous instantaneous local tooth arrangement force and the subsequent instantaneous local tooth arrangement force are correlated with each other by a comparison of a value of the previous instantaneous local tooth arrangement force and a value of the subsequent instantaneous local tooth arrangement force.

6. The method according to claim 5, wherein for each of the measurement locations on the shaping tooth arrangement, based on a result of the comparison of the value of the previous instantaneous local tooth arrangement force and the value of the subsequent instantaneous local tooth arrangement force it is determined as the local state identification value, at least one of:

a mean value of the value of the instantaneous local tooth arrangement force, a temporal development of the value of the instantaneous local tooth arrangement force, a mathematical derivative of the temporal development of the value of the instantaneous local tooth arrangement force, and a mathematical integral of the temporal development of the value of the instantaneous local tooth arrangement force.

7. The method according to claim 1, wherein information relating to the functional state of the shaping tooth arrangement is obtained by the local state identification value determined for the measurement location being compared with a local reference state identification value associated with the measurement location for each of the measurement locations and by evaluating the comparison results obtained for all the measurement locations by means of the numerical evaluation device.

8. The method according to claim 7, wherein the local reference state identification values associated with the measurement locations are empirically established.

9. The method according to claim 1, wherein at least one of the following steps is carried out by means of a neuronal network of the numerical evaluation device:

determining for each of the measurement locations the relationship between the previous instantaneous local tooth arrangement force and the subsequent instantaneous local tooth arrangement force by correlating the previous instantaneous local tooth arrangement force and the subsequent instantaneous local tooth arrangement force with each other for each of the measurement locations on the shaping tooth arrangement, determining based on the relationship between the previous instantaneous local tooth arrangement force and the subsequent instantaneous local tooth arrangement force the local state identification value which is associated with the measurement location for which the local state identification value has been determined and which is specific to the functional state of the shaping tooth arrangement for each of the measurement locations on the shaping tooth arrangement, and obtaining information relating to the functional state of the shaping tooth arrangement on the basis of the local state identification values.

10. A production method for forming a metal workpiece by means of a shaping tooth arrangement which is provided on a forming tool, comprising performing a relative movement of the shaping tooth arrangement and the workpiece by moving the shaping tooth arrangement and the workpiece, which is in contact with the shaping tooth arrangement, relative to each other with a stroke along a movement path by means of a forming drive of a forming machine, performing the method according to claim 1 during the relative movement of the shaping tooth arrangement and the workpiece, and controlling the forming drive of the forming machine during the relative movement of the shaping tooth arrangement and the workpiece by means of a numerical drive control based on information on the functional state of the shaping tooth arrangement, which information has been obtained by means of the method according to claim 1.

11. A device for monitoring a functional state of a shaping tooth arrangement on a forming tool for forming metal workpieces, the device comprising:

a measuring device configured for measuring a tooth arrangement force acting on the shaping tooth arrangement during a relative movement of the shaping tooth arrangement and a workpiece that is in contact with the shaping tooth arrangement, which relative movement is a stroke which the shaping tooth arrangement and the workpiece carry out relative to each other along a movement path of the relative movement of the shaping tooth arrangement and the workpiece, at measurement times which are temporally staggered with respect to each other and at a plurality of measurement locations on the shaping tooth arrangement the measuring device thereby being configured to determine at each of the measurement times for each of the measurement locations an instantaneous local tooth arrangement force as the tooth arrangement force, and the device further comprising a numerical evaluation device configured for determining for each of the measurement locations a relationship between a previous instantaneous local tooth arrangement force determined at an earlier measurement time and a subsequent instantaneous local tooth arrangement force determined at a later measurement time by correlating for each of the measurement locations the previous instantaneous local tooth arrangement force and the subsequent instantaneous local tooth arrangement force with each other, for determining for each of the measurement locations based on the relationship between the previous instantaneous local tooth arrangement force and the subsequent instantaneous local tooth arrangement force a local state identification value which is associated with the measurement location for which the local state identification value has been determined and which is specific to the functional state of the shaping tooth arrangement, and for obtaining based on the local state identification values associated with the measurement locations, information relating to the functional state of the shaping tooth arrangement.

12. The device according to claim 11, wherein the measurement device has a plurality of force sensors which form the measurement locations on the shaping tooth arrangement and which are offset relative to each other perpendicularly to the movement path of the relative movement of the shaping tooth arrangement and the workpiece which is intended to be formed.

13. The device according to claim 11, wherein the numerical evaluation device is a microprocessor.

14. A forming machine for forming metal workpieces, comprising:

a forming tool which has a shaping tooth arrangement, a forming drive by means of which the shaping tooth arrangement of the forming tool and a workpiece which is intended to be formed by means of the shaping tooth arrangement and which is in contact with the shaping tooth arrangement can be moved relative to each other with a stroke along a movement path, and a device according to claim 11 for monitoring a functional state of the shaping tooth arrangement of the forming tool.

15. The forming machine according to claim 14, wherein the measurement locations on the shaping tooth arrangement are provided at least partially on a tool receiving member of the forming tool which is provided with the shaping tooth arrangement.

16. The forming machine according to claim 14, further comprising a numerical drive control configured for controlling the forming drive, wherein the drive control and the device for monitoring a functional state of the shaping tooth arrangement of the forming tool are connected to each other, and wherein the control of the forming drive depends on the functional state of the shaping tooth arrangement of the forming tool, which state is established by the device for monitoring the functional state of the shaping tooth arrangement of the forming tool.

17. The method according to claim 1, wherein the stroke during which the tooth arrangement force is measured at the measurement times which are temporally staggered with respect to each other and at the plurality of measurement locations on the shaping tooth arrangement is a return stroke which is carried out by the shaping tooth arrangement and the workpiece relative to each other, following a working stroke and in an opposite direction to the working stroke.

* * * * *